United States Patent [19]

Hubbard

[11] 4,080,758

[45] Mar. 28, 1978

[54] WINDOW SAFETY SYSTEM

[75] Inventor: S. Eugene Hubbard, Niles, Mich.

[73] Assignee: Kawneer Company, Inc., Niles, Mich.

[21] Appl. No.: 657,192

[22] Filed: Feb. 11, 1976

[51] Int. Cl.[2] ..... E06B 3/40

[52] U.S. Cl. ..... 49/390; 49/394; 292/262

[58] Field of Search ..... 49/390, 392–394; 292/262, 267

[56] References Cited

U.S. PATENT DOCUMENTS

| | | | |
|---|---|---|---|
| 3,239,893 | 3/1966 | Lundgren | 49/390 |
| 3,474,572 | 10/1969 | Rothemund | 49/390 |

*Primary Examiner*—Kenneth Downey

*Attorney, Agent, or Firm*—Mason, Kolehmainen, Rathburn & Wyss

[57] ABSTRACT

A window safety system for a window having a frame with a head, a sill, and side jambs defining a sash receiving opening, and a sash member mounted in said opening for pivotal movement about a vertical axis between closed, opened and reversed positions relative to said frame, said safety system including a releasable latch assembly spaced intermediately of said pivot axis and one of said jambs for selectively interconnecting said frame and said sash for limiting the initial opening movement of said sash out of said closed position to a ventilating position, said latch assembly being key releasable for permitting further free swinging opening movement of said sash member toward a fully reversed and latched position for window washing.

19 Claims, 14 Drawing Figures

FIG. 1
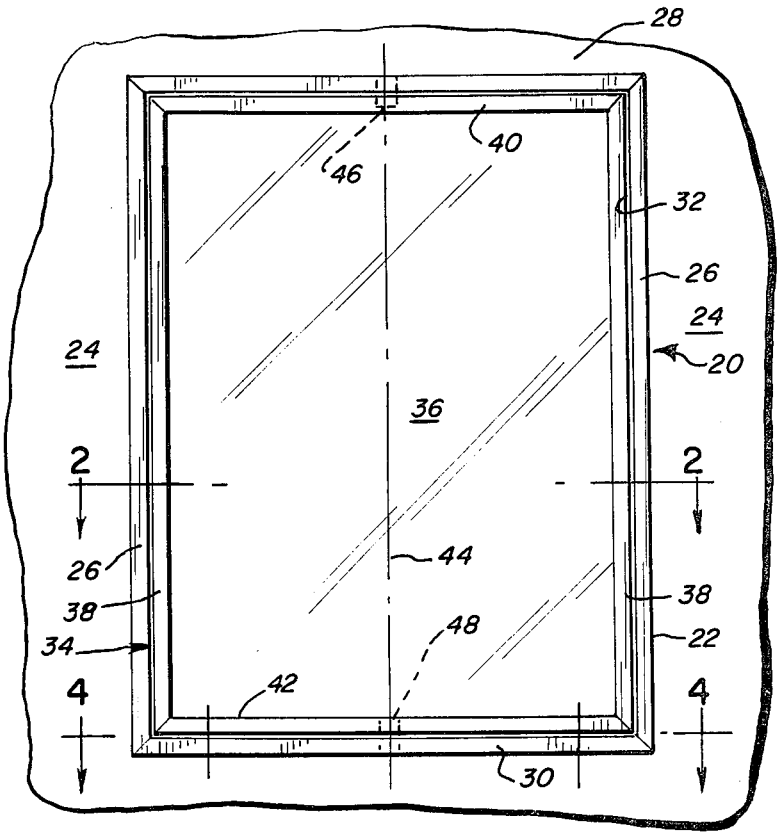
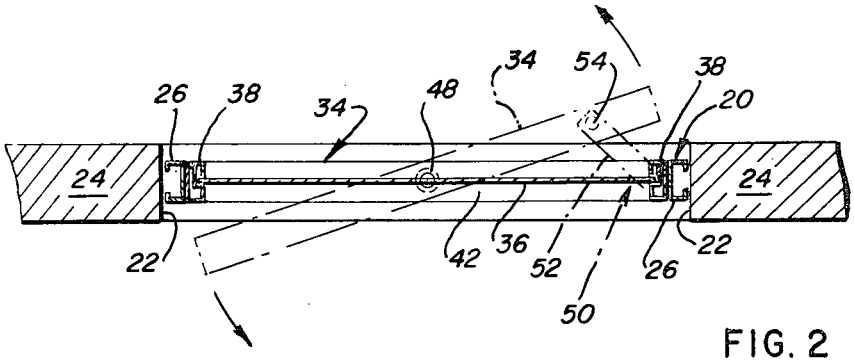
FIG. 2
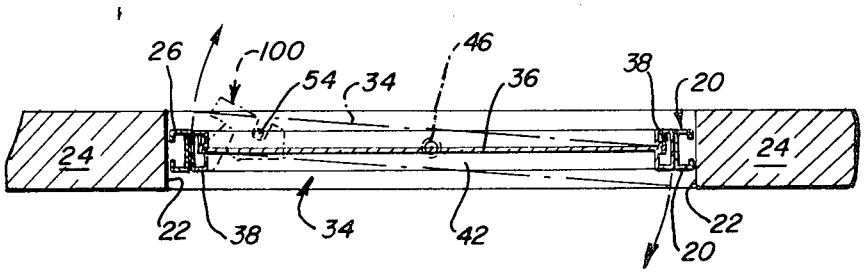
FIG.3

FIG. 6
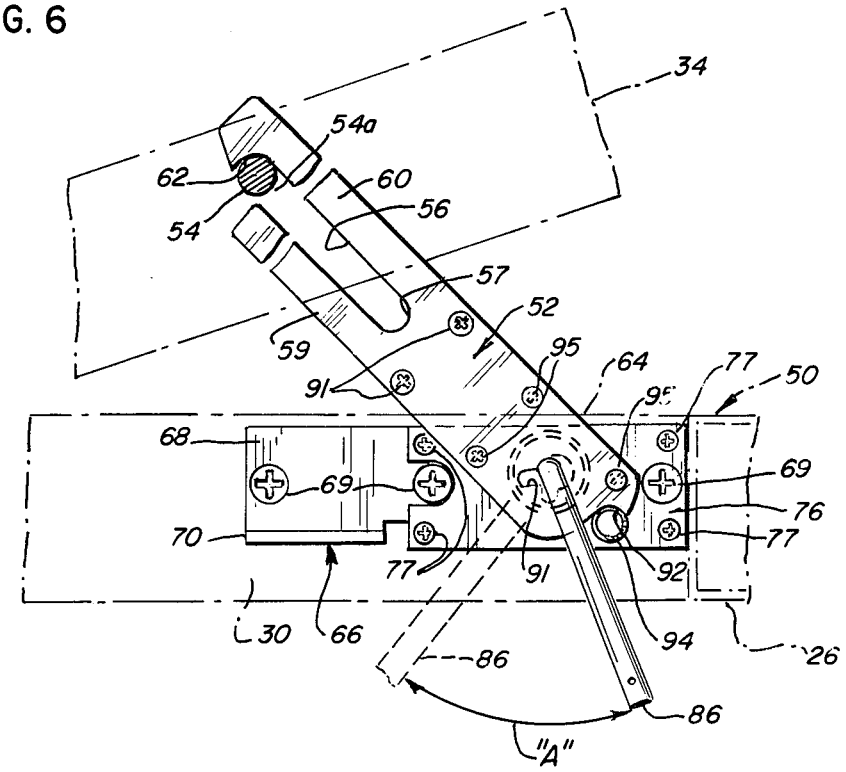
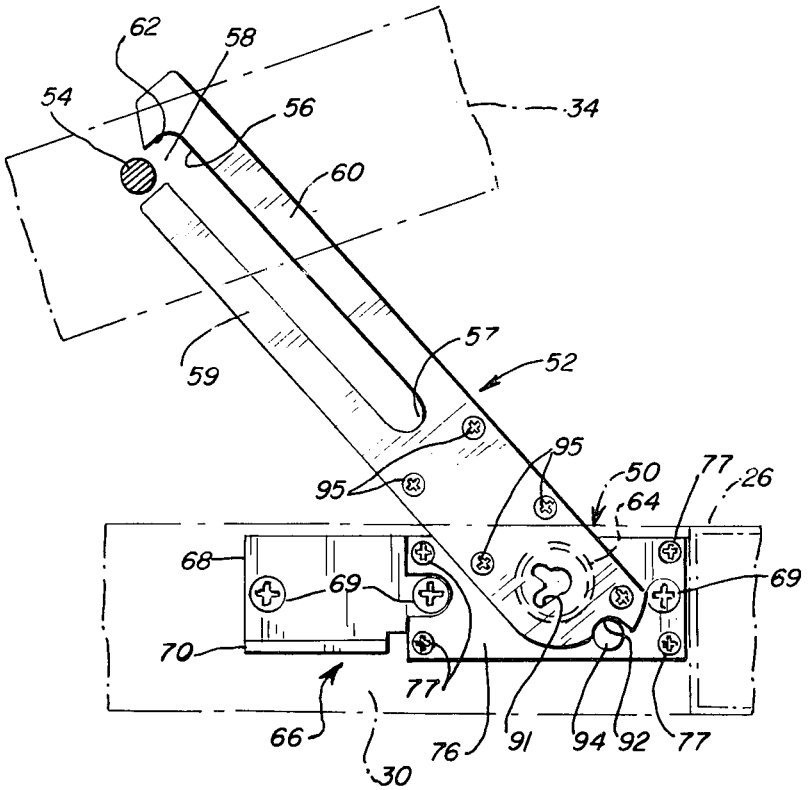
FIG. 7

WINDOW SAFETY SYSTEM

BACKGROUND OF THE INVENTION

1. Field of the Invention

The present invention relates to windows of the type employing a sash pivoted in a frame about a vertical pivot axis and most commonly used in large multi-story, high rise apartments and commercial buildings. Relatively large windows mounted to pivot about a vertical axis are becoming more common in modern day building structures and especially in multi-story, high rise apartments and commercial buildings. In the recent past, many buildings have been built with fixed windows or glass panes and many problems have been encountered with this type of construction.

Because of power failures, brownouts, blackouts, air conditioning failures and the like, it has become necessary and it is sometimes required in building codes to have windows that are readily opened for emergency ventilation without requiring special tools or keys and without requiring specific technical knowledge of the person opening the window. Weather sealing is a problem with any type of window and it is generally required that the window sashes be tightly gasketed into the frame. When the opening of a tightly sealed window requires a considerable force, after the seal is broken, the window is likely to open very rapidly and this sometimes results in the danger of a person falling out of the window as it is pivoted to the open position. This is especially true with large floor to ceiling windows pivotable about a vertical axis. In order to eliminate this hazard, special keys or wrenches are often required for opening these types of windows and the possession of these keys or wrenches is normally closely controlled by the building management in order to prevent accidents. Normally the keys are not readily available to the tenants or other occupants. In the case of an emergency, such as fire or blackout where rapid ventilation is required, building occupants are often unable to open the windows and the only alternative is to break the glass with the resultant dangers involved in this course of action.

2. Description of the Prior Art

In U.S. Pat. No. 2,812,557, therein is illustrated a window construction in which a relatively large window sash is mounted for pivotal movement about a vertical axis. The Hauck type window as shown, includes a safety system wherein latch bolts must be first released from strike plates and then subsequent opening of the window is limited by sash arresters on the jambs which then must be manually moved out of the path of travel of the sash.

A pair of sash arresters are required and once they are moved away from the path of travel of the sash, the sash is free to swing fully open. Because the sash arresters are mounted on the jambs of the window, very little air ventilation is provided when large windows are involved because of the limited space of the opening in comparison to the overall window size. Because the sash arresters are mounted on the jambs, a standardized system is not useable for windows of various different sizes without extensive modification. The amount of opening that might provide adequate ventilation for a small window with a particular size sash arrester would not be nearly enough for a relatively large wide window because of the fact that the sash arresters are mounted on the fixed jamb of the window frame and the angular amount of opening for a given size sash arrester on a large window would be much smaller than for a relatively small window. Also, the sash arresters are readily operable by the building occupants with the consequent danger that an occupant could fall out of the window upon opening.

U.S. Pat. No. 3,474,572 discloses a key operated window safety fixture for a window sash pivoted on a vertical axis. The safety mechanism is interconnected between the frame and sash at the pivot point of the sash and this is subjected to high operating torque. Accordingly, the safety mechanism must be constructed of extremely strong materials such as costly stainless steels and the like in order to reduce the possibility of failure in a critical situation when relatively large forces are exerted to open the window sash in a panic by personnel or by a high wind load after opening occurs. In addition, extra care is required in order to assume that the mechanism is adequately secured to the sash and frame.

OBJECTS OF THE INVENTION

The present invention is directed toward the elimination of the difficulties and shortcomings of the prior art structures as described and accordingly, it is an object of the present invention to provide a new and improved window safety system.

Another object is to provide a safety system for a window pivotally mounted about a vertical axis, which system eliminates or greatly diminishes the possibility of a person falling out of the window as it is opened.

It is another object of the present invention to provide a window safety system of the character described which readily permits opening of the window in a controlled and safe manner by an occupant without requiring skill or knowledge of the window safety system.

Another object is to provide a window safety system which is universally adaptable for windows of different sizes and permits the window to be opened safely for sufficient ventilation in an emergency or the like by an untrained person.

Another object of the invention is to provide a new and improved window safety system of the character described wherein the window may not be opened beyond a limited open position used for emergency ventilation except by the use of a special key or wrench.

Another object of the present invention is to provide a new and improved window system of the character described wherein the window sash may be fully opened to a reverse position and positively retained in the reverse position for washing the outside surface of the window from the inside of the building.

Still another object of the present invention is to provide a new and improved window system of the character described wherein the window sash is freely swingable in a range between a limited open position and a fully reverse position for washing.

Yet another object of the present invention is to provide a new and improved window system of the character described wherein the sash is positively locked in a reversed position for window washing and may not be unlocked until a wrench or key is utilized to operate a reverse latching mechanism thereof.

Still another object of the present invention is to provide a window system wherein a window sash may not be returned from a fully open position to a limited ventilating open position until a key is utilized to operate a pivot angle limiting safety system.

Still another object of the present invention is to provide a new and improved window system of the character described wherein a special key is suitable for controlling a pivot angle limiting safety mechamism and a reverse position latching system.

Still another object of the present invention is to provide a new and improved window system of the character described wherein a standard size safety system is suitable for use without modification on a large range of window sizes.

Another object of the present invention is to provide a new and improved window system of the character described which is reliable and safe in operation and which is relatively low in cost, and simple of construction.

SUMMARY OF THE INVENTION

The foregoing and other objects and advantages of the present invention are accomplished in a new and improved window safety system comprising, in combination, a window frame having a head, a sill and a pair of side jambs defining a sash receiving opening. A sash is mounted in the opening for pivotal movement about a vertical axis between a closed position, a limited open position for emergency ventilation and a fully reversed position suitable for internal washing of the exterior glass surface. A releasable latch assembly is spaced intermediate the pivot axis and one of the side jambs of the frame for interconnecting the window frame and the sash in order to limit the initial pivoting opening movement of the sash from the closed position. The latch mechanism is key releasable for permitting further free swing opening movement of the sash toward a fully reversed position. A second latch mechanism, also key operable, is provided for positively latching the sash in a fully reversed position so that the outside surface of the window may be washed from the inside of the building.

BRIEF DESCRIPTION OF THE DRAWINGS

For better understanding of the present invention, reference should be had to the following detailed description taken in conjunction with the drawings in which:

FIG. 1 is an elevational view of a window having a safety system constructed in accordance with the features of the present invention;

FIG. 2 is a horizontal cross-sectional view taken substantially along lines 2—2 of FIG. 1 and showing in phantom the window in a ventilating position;

FIG. 3 is a view similar to FIG. 2, but showing in phantom the window sash in a fully reversed position suitable for washing of the outside surface of the window from the inside of the building;

FIG. 6 is an enlarged fragmentary plan view of a latch portion of the window safety system in accordance with the invention showing the pivot angle limiting latch system in a position positively limiting the initial opening movement of the sash;

FIG. 7 is a view similar to FIG. 6 but showing the latching system after it has been released by the use of a special key permitting the sash to be fully opened and freely pivotable into a fully reversed position ready for washing;

BRIEF DESCRIPTION OF THE PREFERRED EMBODIMENT

Figure 4:
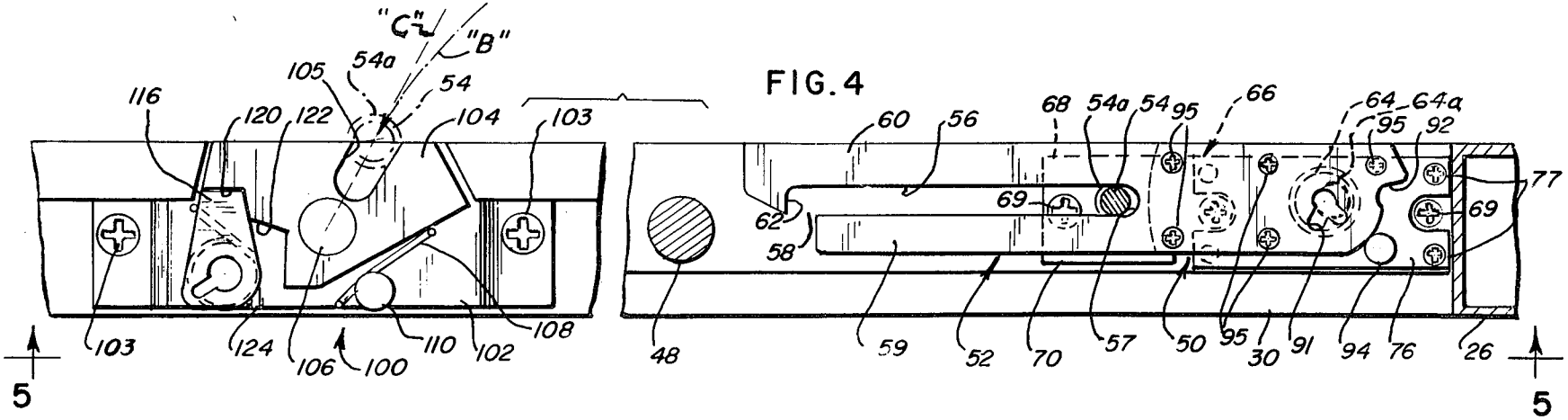
FIG. 4 is a fragmentary sectional view taken substantially along lines 4—4 of FIG. 1.

Referring now more particularly to the drawings, therein is illustrated a new and improved window safety system constructed in accordance with the features of the present invention. A window frame 20 is mounted in a rectangular opening or space 22 in the wall of a building structure 24 and the window frame includes a pair of vertical side members or jambs of channel-shaped cross-section (FIGS. 2 and 3), a horizontal upper header 28 and a lower sill 30. The frame defines a rectangular, sash receiving opening 32 in which is mounted a rectangular window sash 34 having a large glazing panel 36 mounted therein. The sash includes a pair of vertical side members or stiles 38 of generally tubular, rectangular cross-section (as shown in FIGS. 2 and 3), each having a glazing channel for receiving a side edge portion of the glazing panel 36. The stiles of the sash are interconnected adjacent the upper end by an upper horizontal rail 40 and at the lower end by a lower rail 42.

The sash 34 is supported in the window frame 20 for pivotal movement about a centrally positioned, vertical axis 44 and is pivotal slightly less than 180° from a closed or sealed position (solid lines, FIG. 2), through a limited open, ventilating position (shown in phantom in FIG. 2) and, after release from the limited open position, to a fully reversed window washing position as shown in phantom in FIG. 3 wherein the outside surface of the glass 36 is directed inwardly so that the window may be washed from inside the building. The sash is supported for pivotal movement on the vertical axis 44 by a pair of upper and lower axle assemblies 46 and 48 pivotally interconnecting the upper sash rail 40 and the lower sash rail 42 with the header 28 and sill 30 of the window frame 20. Because the life safety system of the present invention is not directly associated with the axle assemblies 46 and 48, these assemblies can be designed as heavy as required dependent on the window size involved to provide for smooth and easy pivotal movement of the sash within the window frame 20. The axles are preferably mounted at the center of the window frame so that good balance on the sash is provided during pivotal movement.

In accordance with the present invention, the window safety system includes a pivot limiting safety latch 50 (as shown in FIGS. 4 through 7 and 9 through 11) which is especially adapted for limiting the initial opening movement of the sash out of the closed or sealed position aligned with the frame. The latch 50 limits the initial opening of the window to an open, ventilating position (as shown in FIG. 2 in phantom), which is sufficient to provide adequate ventilation but the open area between the sash stile and adjacent side jamb is limited to an extent that it is impossible for a person to fall out of the building through the open area. The safety latch is mounted on the upper surface of the sill 30 of the window frame and the position thereon between one of the side jambs 26 and the pivot axis 44 at the center of the frame at a point (dependent on the width of the sash) which provides the desired width of opening for ventilating purposes. Accordingly, a safety latch 50 of a standard size may be utilized with narrow as well as wide window sashes in each case, the width of the initial opening permitted is set up by positioning the latch so that it would be impossible or highly unlikely that a person in the building could fall through the limited open space when the window sash is in the limited open or ventilating position (as shown in phantom in FIGS. 2 and 6). With windows of smaller size, the safety latch may be moved outwardly toward the side jamb and with windows of larger width, the position of the latch 50 may be moved closer toward the central pivot axis 44 in order to achieve approximately the same width of window opening.

The safety latch includes a slotted pivot arm 52 which is engageable with a latch pin 54 depending from the lower rail 42 of the sash 34 and the latch pin is formed with an enlarged lip 54*a* at the lower end to prevent disadvertent disengagement from the arm. The pivot arm 52 includes an elongated slot 56 terminating in a blind end 57 and open laterally adjacent an outer end 58. A pair of legs 59 and 60 define opposite side edges of the slot 56 and the longer of the legs 60, includes a stop surface 62 at the outer end of the slot in the arm for directly engaging the latch pin 54 to positively prevent further opening movement of the sash 34 until the latch is released.

Figure 10:
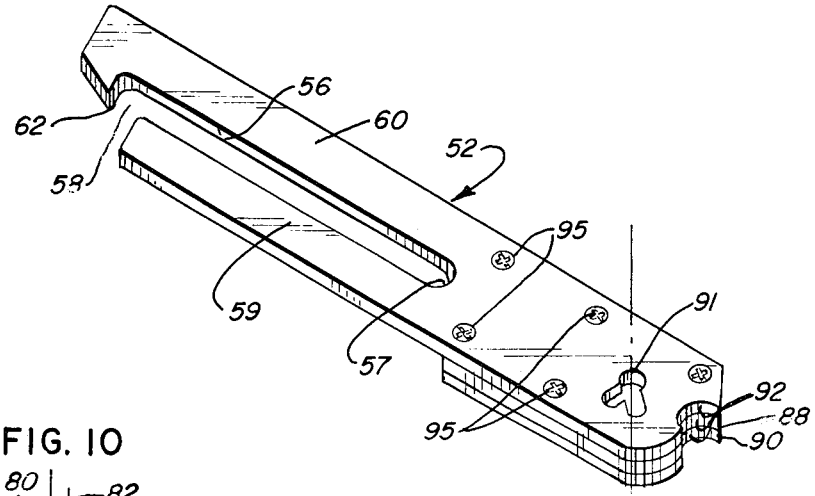
FIG. 10 is a side elevational view of the key operated eccentric pivot pin used in the pivot limiting latch system.
Figure 9:
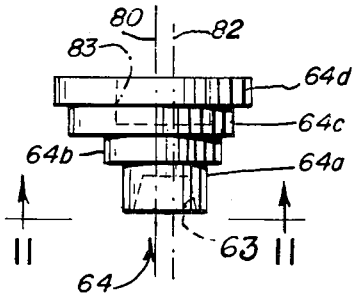
FIG. 9 is an exploded perspective view of the pivot limiting latch system of the present invention.
Figure 9:
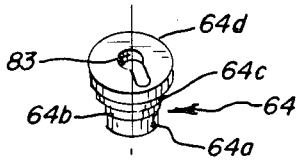

The arm 52 is supported for pivotal movement adjacent its inner end on an eccentric pivot button 64 (as best shown in FIGS. 9 and 10). The eccentric pivot is mounted on a bracket 66 having a lower base flange 68 secured to the upper surface of the window frame sill 30 by suitable fasteners 69. The bracket 66 includes an upstanding stop lug 70 which limits the inward travel of the arm 52 when the window is fully closed. The base 68 is provided with a stepped diameter circular bore 72 for journaling a lower end or axle portion 64*a* of the eccentric pivot, and as shown in FIG. 10, the lower end portion 64*a* is hollowed out to facilitate spinning over (FIG. 5) for retaining the eccentric pivot 64 in the stepped bore of the base flange.

Above the axle portion, the eccentric pivot is formed with a control cam segment 64*b* having an irregular shape (as shown best in FIG. 11) with a pair of radial stop surfaces 65 angularly spaced apart which limit rotation of the eccentric 64 by engagement with a protruding lug 74 formed in an irregularly shaped opening 75 provided in a base plate 76 which is attached to the upper surface of the base flange 68 by a plurality of flush fasteners 77. The control cam 64*b* of the eccentric pivot also includes a pair of angularly intersecting flatted surfaces 67, for bearing against a small leaf spring 78 which is mounted in the opening 75 of the base plate 76. Engagement of the leaf spring against the flats 67 stabilizes the eccentric pivot 64 in either of two extreme angular positions as limited by engagement of one of the stop surfaces 65 against the lug 74 in the opening 75 of the base plate 76. Above the cam segment 64*b*, the eccentric pivot 64 is formed with a circular bearing segment 64*c* and this portion serves as the main bearing support for the pivot arm 52. Above the segment 64*c*, the eccentric pivot includes a slightly larger circular head 64*d* which serves to retain the arm 52 on the eccentric pivot.

Figure 11:
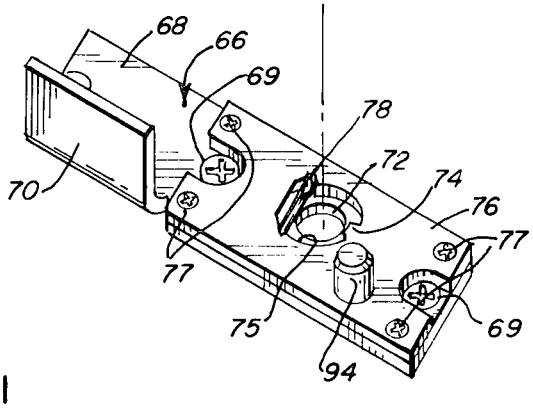
FIG. 11 is a sectional view of the eccentric pin taken substantially along lines 11—11 of FIG. 10.
Figure 11:
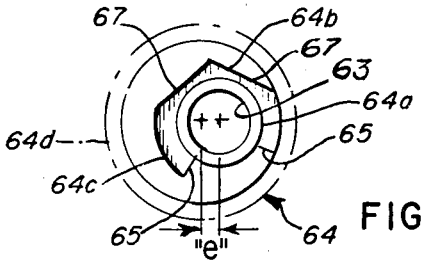

It should be noted that the circular segments 64*c* and 64*d* are generated about an axis 80 (FIG. 10), which is eccentric of the central axis 82 of the lower bearing portion 64*a* of the pivot by a distance labeled "e" in FIG. 11. Accordingly, when the pivot 64 is rotated between a first and a second stop position wherein one or the other of the stop surfaces 65 is engaged against the lug 74 in the bore 75 of the plate 76, the pivot or bearing segment 64*c* which supports the arm 52 is eccentrically moved with respect to the base bracket 66 on the sill 30 of the window frame.

Figure 13:
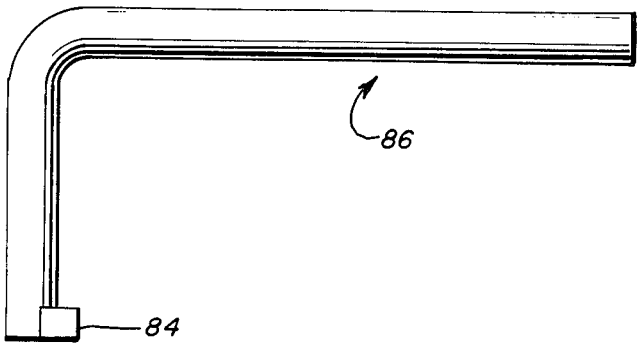
FIG. 13 is a side elevational view of a latch releasing key or wrench used for the latching mechanisms of the present invention.
Figure 14:
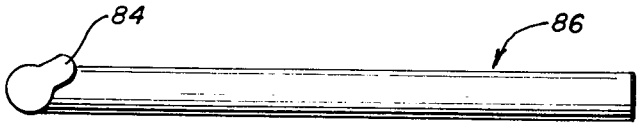
FIG. 14 is a bottom view of the key or wrench of FIG. 13.

As best shown in FIG. 9, the upper circular segments 64*c* and 64*d* of the eccentric pivot are formed with a key slot 83 having a circular segment at the center and a radially outwardly extending leg. This key slot is adapted to receive a key lug 84 on the end of a leg of an L-shaped wrench or key 86 (as shown in FIGS. 13 and 14). When the key lug 84 is inserted into the slot 83, and the L-shaped key is rotated, the eccentric pivot 64 is rotated from one to the other of its extreme angular positions as limited by engagement of the stop surfaces 65 with the tooth 74 in the bore 75 of the base plate 76. The leaf spring 78 aids in forcing and maintaining the eccentric into one or the other of its extreme angular rotative positions relative to the base bracket 66 on the sill member 30 of the window frame 20.

Referring more particularly to FIG. 9, the inner end portion of the pivot arm 52 is attached to a pair of plates 88 and 90 for engagement with eccentric pivot 64 to support the arm for pivotal movement and provide a bearing surface therefor. Th intermediate plate 88 is formed with a circular opening 88*a* (FIG. 5) large enough to accommodate the upper head portion 64*d* of the eccentric pivot 64 and the lower plate 90 is provided with a smaller diameter circular opening 90*a* to accommodate the bearing segment 64*c* of the eccentric pivot and thereby retains the pivot arm 52 on the upper end or head 64*d* of the eccentric pivot. The plates 88 and 90 are secured to the pivot arm 52 by a plurality of flush headed fasteners 95.

In accordance with the present invention, the pivot arm 52 is formed with a Y-shaped key slot 91 adapted to receive the key lug 84 of the key wrench 86 in one of two relative positions. The key slot 91 is formed with a central circular segment concentric with the circular segment of the key slot 83 in the eccentric pivot 64. The angularly divergent legs of the key slots 91 are adapted to accommodate the key lug 84 of the key wrench 86 in either one of a pair of angularly divergent positions relative to the pivot arm when the arm is fully extended and this arrangement positively prevents removal of the key unless the pivot has been rotated to one or the other of its extreme angular positions. The inner or butt end of the pivot arm and the plates 88 and 90 secured thereto, are formed with an S-shaped stop surface 92 (as shown in FIG. 9) for engaging a fixed stop pin 94 which is mounted on the base plate 76.

Referring to FIG. 4, when the window is closed, the latch pin 54 is adjacent the blind end 57 of the slot 56 in the pivot arm 52 and the arm is generally parallel of the lower sill 30 of the window frame 20. In this position, the stop pin 94 is spaced from the stop surface 92 on the inner end of the pivot arm. Referring to FIG. 6, when the window sash 34 is opened to the limited open position for ventilation and is pivoted in a counterclockwise direction from the full closed position of FIG. 4, the pivot arm 52 is rotated in a clockwise direction about the bearing surface 64c on the eccentric pivot 64. Rotation of the pivot arm 52 continues as the latch pin 54 moves outwardly in the slot 56 until the pin engages the stop surface 62 adjacent the outer end of the slot. This engagement limits further opening of the sash and the amount of opening depends on the length of the pivot arm and the position that the bracket 60 is mounted on the sill 30 relative to the axis 44 and side jamb 26. For a particular width of a window, the safety latch 50 is mounted a selected distance away from the pivot axis 44 toward a side jamb 26 so that the amount of initial opening of the window is limited in order to prevent a person from inadvertently falling out of the open window. An untrained occupant or tenant of a building may readily open the sash 34 to the limited open or ventilating position (as shown in FIG. 6) without danger of falling out through the open space and without requiring the use of a special key or wrench to unlock the window. This is particularly desirable when emergency ventilation is required.

Because of the engagement of the latch pin 54 on the sash 34 with the stop end 62 in the slot of the pivot arm 52, the sash is positively restrained against further wider opening. In order that the sash may be more widely opened, the key or wrench 86 is utilized and the key lug 84 at the lower end of the shorter leg of the key is inserted downwardly through the key slot 91 in the pivot arm 59 into the key slot 83 of the eccentric pivot 64. The long arm of the key is rotated in a clockwise direction as shown in FIG. 6, from the position shown in solid lines to the position shown in dotted lines through an angle of about 45° as represented by the arcuate arrow "A". When this occurs, the eccentric pivot 64 is rotated in the bore 72 of the base plate bracket and the pivot axis 80 for the pivot arm is rotated around the axis 82. When this occurs, the pivot arm 52 is then free to pivot further in a clockwise direction from the position of FIG. 6 to the position of FIG. 7, wherein the stop surface 62 on the other end of the slot 56 in the arm is no longer in stopping engagement with the latch pin 54 of the sash. The sash may now be pivoted freely from the open ventilating position of FIG. 6 almost 170° to the reversed position for window washing as shown in FIG. 3 (solid lines). The pivot arm 52 remains in the position as shown in FIG. 7 and the eccentric pivot 64 is retained in the eccentric position by engagement between a cam surface 76 and the leaf spring 78 as previously described. The stop surface 92 on the butt end of the pivot arm engages the pin 94 and this engagement prevents pivotal movement of the pivot arm from the position of FIG. 7, until the eccentric pivot 64 is returned to its normal position as shown in FIG. 4.

Figure 5:
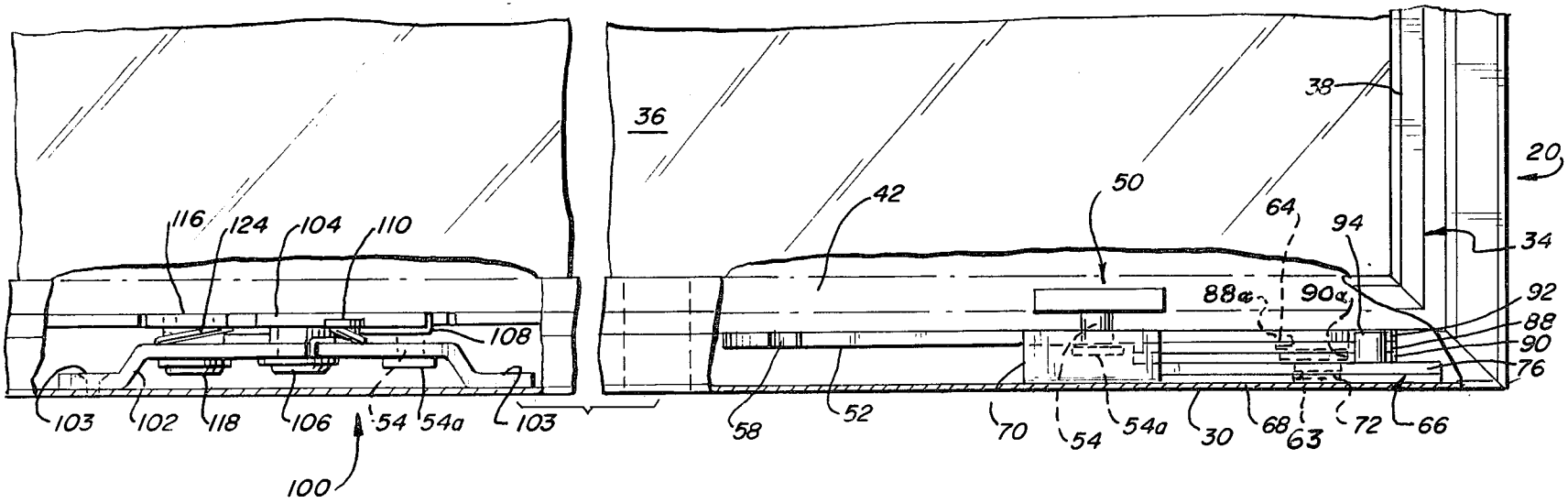
FIG. 5 is an enlarged elevational view looking in the direction of the arrows 5—5 of FIG. 4, with portions broken away to show internal details.
Figure 12:
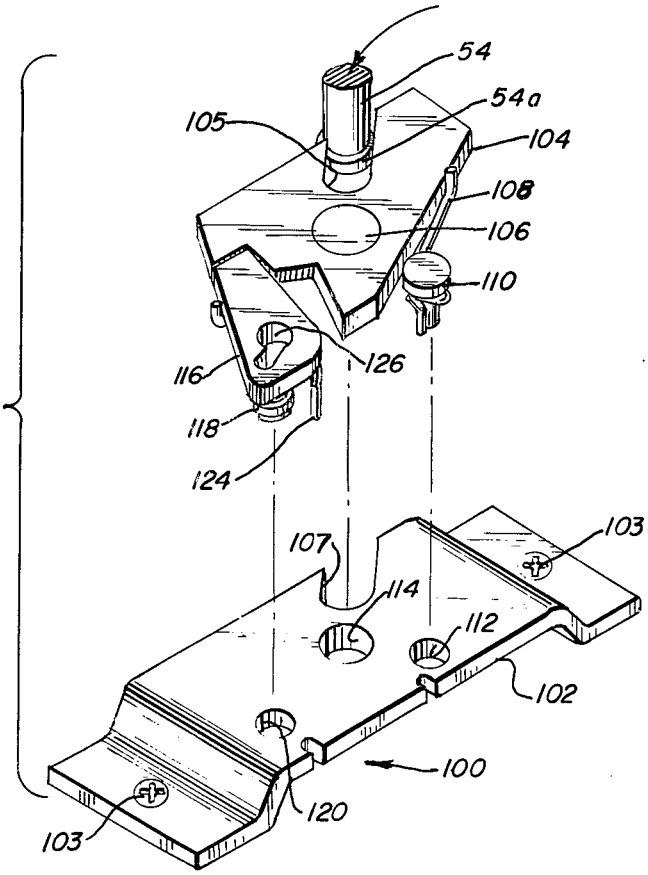
FIG. 12 is an exploded perspective view of the window washing latch system in accordance with the present invention.

In accordance with the present invention, the window safety system also includes a window washing safety latch, generally indicated by the reference numeral 100 (FIG. 12). The washing latch is adapted to positively latch the window sash 34 in an almost fully reversed position (FIG. 3, phantom lines) for window washing with the outside surface of the glass 36 facing inwardly so that the window can be washed from the inside of the building. The washing safety latch includes a channel shaped mounting bracket 102 secured to the lower sill 30 of the window frame 20 at opposite ends by a pair of fasteners 103. The mounting bracket serves as a base for supporting a capture cam 104 having a slot 105 in the outwardly facing edge thereof for receiving the latch pin 54 on the window sash 34 when the sash is moved into the washing position. The bracket also includes a similar but wider slot 107 (FIG. 12). The capture cam is pivotally mounted on the bracket 102 by a pivot pin 106 and is normally biased to a flush position as shown in FIG. 5 wherein the outer surface is even with the outer surface of the inner frame sill 30 by means of a coil spring 108 mounted on a pin 110 which is secured in an aperture 112 in the base bracket. As shown in FIG. 12, the pin 106 supporting the capture cam 104 extends into an aperture 114 in the base bracket and is secured in position by spinning over the lower end of the pin on the underside of the bracket. When the outer edge of the capture cam is aligned with the outer edge of the frame sill 30 (as shown in FIG. 4), the open end of the slot 105 of the capture cam is positioned to receive the latch pin 54 on the window sash 34 as the sash is pivoted into the reverse position for washing.

It should be noted from FIG. 4, that an arcuate travel path of the latch pin 54 (represented by the arrow "B") is substantially tangentially aligned with the axis of the receiving slot 105 in the cam. After engagement of the pin in the slot, further inward movement of the pin pivots the capture cam 104 on the pivot pin 106 in a clockwise direction as into the window washing latch position as shown in solid lines in FIG. 8.

Figure 8:
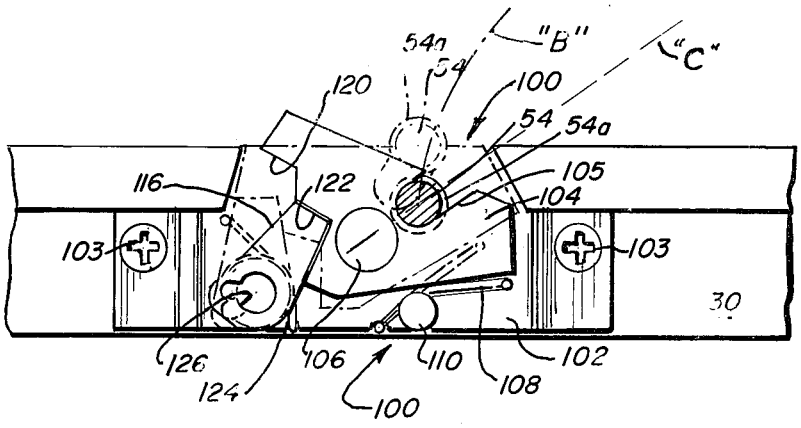
FIG. 8 is a fragmentary plan view of a window washing latching feature in accordance with the invention showing the window positively held in a fully reversed position ready for washing.

In the latched position of FIG. 8, the axis of the slot 105 in the capture cam is at a substantial angle (Line "C") relative to the arcuate path of travel of the latch pin 54 so that excellent holding is obtained when the latch is engaged as shown in FIG. 8. In order to maintain the capture cam 104 in the latched position after capture of the latch pin 54 on the window sash 34 in the slot 105, the window washing latch 100 includes a pawl 116 having a pivot shaft 118 which extends through an aperture 120 in the mounting bracket 102. The lower end of the shaft 118 is secured to the bracket by spinning over in the same manner as the pins 106 and 110. Pawl 116 includes an outer end portion adapted to engage a selected one of a pair of stop surfaces 120 and 122 on the butt end of the capture cam 104. The pawl 116 is biased in a clockwise direction toward the capture cam 104 by a coil spring 124 and the pressure of the opposing coil springs 108 and 124 acting on the capture cam 104 and the pawl 116 act to maintain the cam in the position (shown in FIG. 4) when not engaged with the latch pin 54 on the window sash 39. After capture of the pin, further inward travel rotates the capture cam 104 clockwise into the latched position (as shown in FIG. 8) and the pawl spring 124 causes the pawl to pivot in a clockwise direction until the outer end surface of the pawl engages the stop surface 122 on the capture cam 104 as shown in FIG. 8. This engagement positively retains the capture cam in a position to firmly secure the window sash 34 for washing without danger of becoming unlatched.

The pawl 116 is formed with a key hole slot 126 for releasing the pawl and the key hole slot 126 is adapted to receive the same key 86 as used on the safety pivot limiting latch 50. After a window washer has completed the washing job, it is necessary to insert the key lug 84 into the pawl slot 126 and rotate the pawl in a counterclockwise direction to release the capture cam 104 which is rotated in a counterclockwise direction by a spring 108. As this occurs, the latch pin 54 on the window sash 34 is forced outwardly and the window sash is pivoted back toward the ventilating open position as shown in FIG. 7. This provides a safety feature in that a tenant or building occupant without a key cannot release and open a window that may have been left by a window washer latched in the reversed position.

After the window sash is returned to the position of FIG. 7, the latch pin 54 is directly aligned with the outer end of the shorter finger 59 of the slotted pivot arm 52 and the pin cannot be captured in the slot 56 until the arm is pivoted to the position of FIG. 6. This engagement between the pin and arm prevents closing of the window sash 34 until such time as the window washer or other attendant inserts the wrench key 86 into the key slots of the pivot arm and the eccentric pivot and rotates the key in a counterclockwise direction to return the eccentric pivot from the eccentric position back to the position of FIG. 4. When this is accomplished, the pivot arm 52 is pivoted to the position of FIG. 6 and the latch pin 54 on the sash is recaptured in the slot 56. The window sash 34 may then be fully closed.

From the foregoing description it will be seen that the window safety system in accordance with the present invention, may be utilized in windows in varying sizes and widths and permits the window to be initially opened only to a limited ventilating open position by a tenant or unskilled occupant of the building not having a key. In an emergency when ventilation is needed, anyone having reasonable facility may open the window a limited amount to provide for ventilation. This initial opening is positively limited so that a person may not inadvertently fall through the opened space. Further opening of the window is accomplished only when a person having a key or wrench 86 releases the safety latch assembly 50 as described, and the window may then be pivoted freely almost 170° into a reversed position for window washing in the reversed position, the window sash 34 is automatically latched as the latch pin 54 is captured in the slot 105 of the capture cam 104 and the window sash is positively retained in a latched condition during the washing process. After the window washing is completed, it is necessary for the window washer or attendant to insert the key or wrench 86 into the key slot 126 of the pawl 116 to release the capture cam 104 to pivot for releasing the latch pin 54 on the window sash 34. After release, the pawl and the pawl spring 124 maintain the capture cam 104 in the ready position as shown in FIG. 4 with the outer surface of the cam flushed with the outer edge of the sill. The window cannot be fully closed again until the pin 54 is captured in the slot 56 of the arm 52 and this cannot occur until the eccentric pivot 64 is returned to a normal position by use of the key 86 as described. Because of this arrangement, the window washer is effectively reminded that something else needs to be done before leaving the window as the window cannot be closed until the pin is recaptured in the slot of the pivot arm. After this is accomplished, the window sash 34 may then be closed and sealed. The invention provides an extremely safe and reliable safety system for windows pivoted about a vertical axis, and is relatively low in cost, relatively fool-proof in operation and is installable on existing windows.

Although the present invention has been described with reference to several illustrative embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. In combination, a window frame having members including a header, a sill and a pair of jambs defining a sash receiving opening;

a sash member mounted in said opening for pivotal movement about a pivot axis extended transversely between opposite one of said frame members between a closed, open and a reverse position relative to said frame member; and a releasable latch assembly positioned apart from said axis and one of said jambs at an adjustably selected spacing therebetween, said latch assembly interconnecting said frame member and said sash member for limiting the amount of initial pivotal opening movement of said sash member out of said closed position into a limited open position and including key releasable means operable for permitting further pivotal opening movement of said sash member out of said limited open position through a freely pivotal open position toward said reverse position, said latch assembly including an arm pivotally attached to one of said members and including a slot therein having an opening for slidably receiving a pin mounted on another of said members, said key releasable means including means for limiting the pivotal movement of said arm for preventing disengagement of said pin from said opening of said slot thereby limiting the amount of pivotal opening movement of said sash member out of said closed position, into said limited open position and operable by a key to permit said pin to move out of engagement with said slotted arm allowing free pivotal movement of said sash member relative to said frame member between said limited open position and said reverse position.

2. The combination of claim 1 wherein said key releasable means includes eccentric pin means for supporting said arm for pivotal movement relative to one of said members, said pin means having a pair of bearing surfaces eccentric of each other, one of said surfaces engaging said arm and the other of said surfaces engaging said one member.

3. The combination of claim 2 including stop means for limiting the pivotal movement of said arm relative to said one member.

4. The combination of claim 2 including means for maintaining said eccentric pin means in a pair of rotative positions relative to said one member.

5. The combination of claim 1 including a second latch assembly spaced intermediate said axis and the other of said jambs for holding said sash member in a reverse position with an outer surface thereof facing inwardly.

6. The combination of claim 5 wherein said second latch means includes a latch pivotally mounted on one of said members and including a capture slot, and a pin mounted on the other of said members adapted to be received in said slot.

7. The combination of claim 6 wherein said latch is pivotal between an open position for receiving said pin and a latched position for holding said pin to prevent relative movement between said members.

8. The combination of claim 7 including pawl means for retaining said latch in said latched position.

9. The combination of claim 8 wherein said pawl means includes a key receiving slot for receiving a key for pivoting said pawl means between a position retaining said latch in said latched position and a released position.

10. In combination, a window frame having members including a header, sill and jambs defining a sash receiving opening;

a sash member mounted in said opening for pivotal movement about a pivot axis extended transversely between opposite one of said frame members between a closed, open and a reverse position relative to said frame member; and a releasable latch assembly positioned apart from said axis and one of said jambs at an adjustably selected spacing therebetween, said latch assembly interconnecting said frame member and said sash member for limiting the amount of initial pivotal opening movement of said sash member out of said closed position into a limited open position and including key releasable means operable for permitting further pivotal movement of said sash member out of said limited open position through a freely pivotal open position toward said reverse position, said latch assembly including a key operated latch movable between a latching and a releasing position for permitting said free opening movement of said sash member, and means for retaining said key in said latch whenever said latch is intermediate said latching and releasing positions.

11. The combination of claim 10 wherein said latch comprises a lever arm pivotally mounted on an eccentric pivot for relative movement between said latching and releasing positions, said retaining means comprising means on said lever arm engaging said key to prevent withdrawal of said key from said latch assembly.

12. The combination of claim 11 wherein said lever arm and said pivot include slots for receiving said key, said slots having portions alignable to permit insertion and withdrawal of said key from said latch assembly.

13. The combination of claim 1 wherein said latch assembly includes a pair of latch members mounted for relative rotation about a pivot axis, each of said members including a key slot for receiving a release key having a portion extending radially outward of said axis and stop means on one of said members preventing withdrawal of said release key from said slots until said radially extended portions are aligned by relative rotation of said members about said axis.

14. The combination of claim 13 wherein said latch members comprise a lever arm pivotally mounted on an eccentric pivot which is mounted on the sill of said window frame, said key insertable into said slot in said pivot rotate said pivot relative to said lever arm and said sill between first and second positions of alignment of said slots on said lever arm and pivot.

15. The combination of claim 14 wherein said stop means comprises a portion of said lever arm spaced between a pair of angularly divergent radially extending slots formed therein.

16. The combination of claim 1 including means for retaining said arm in a fixed position relative to one of said members after said key releasable means is actuated to permit disengagement of said pin from said slot for further opening of said sash member.

17. The combination of claim 16 wherein said arm includes a stop surface thereon for engaging said pin to prevent closing of said sash when said arm is in said fixed position.

18. The combination of claim 17 wherein said stop surface is aligned to communicate with a surface of said slot in said arm to guide said pin into recapture in said slot when said key releasable means is actuated permitting pivotal movement of said arm from said fixed position to a sash opening limiting position.

19. The combination of claim 18 wherein said sash opening limiting position of said arm comprises a range of relative angular relations between said arm and said one member.

* * * * *